United States Patent [19]

Mueller

[11] 4,095,789

[45] Jun. 20, 1978

[54] TORSION SPRING TYPE WRIST EXERCISING DEVICE

[76] Inventor: George Mueller, 52 Grandview St., Huntington, N.Y. 11743

[21] Appl. No.: 773,275

[22] Filed: Mar. 1, 1977

[51] Int. Cl.[2] ..... A63B 21/02

[52] U.S. Cl. ..... 272/140

[58] Field of Search ..... 272/67, 68, 140, 135, 272/DIG. 5, DIG. 4

[56] References Cited

U.S. PATENT DOCUMENTS

| | | | |
|---|---|---|---|
| 2,714,008 | 7/1955 | Urban | 272/67 X |
| 2,973,962 | 3/1961 | Griffin | 272/67 |
| 3,396,967 | 8/1968 | Brown | 272/67 |
| 3,717,338 | 2/1973 | Hughes | 272/67 |

*Primary Examiner*—William R. Browne

*Attorney, Agent, or Firm*—Scully, Scott, Murphy & Presser

[57] ABSTRACT

A torsional twist wrist exercising device includes a pair of hand grips disposed in contiguous end-to-end relation on a common central longitudinal axis. The grips are operatively interconnected with each other so as to normally maintain their contiguous relation, but permitting rotative movements thereof relative to each other about their common axis. A central longitudinally extended shaft is affixed at one end to one of the grips and a central longitudinally extended bore is formed within the other grip for coaxially receiving said shaft. At least one torsion spring is supported upon the shaft and spring retaining members are provided for detachably securing one end of the spring to the shaft and the other end of the spring to the wall defining the interior surface of the bore. A cap member is provided for maintaining the contiguous end-to-end relation of the grips during exercising use.

2 Claims, 2 Drawing Figures

TORSION SPRING TYPE WRIST EXERCISING DEVICE

BACKGROUND OF THE INVENTION

This invention relates to the field of exercising devices, and more particularly, to a wrist exercising device incorporating a torsion spring element.

Numerous wrist exercising devices are presently known which operate on the principle of applying a torque, or compression force, to a spring through predetermined manipulation of suitable hand grip elements. Illustrative of such devices are those described in U.S. Pat. Nos. 3,830,493; 3,717,338; 3,666,267; 3,396,967; 2,973,962; 2,714,008; and 1,604,333.

Exercises which strengthen the hand, wrist and forearm muscles are particularly beneficial, and even critical, to those engaged in athletic pursuits where these muscles are constantly brought into play, e.g., when engaged in such sports as baseball, tennis, golf, lacrosse, badminton, hockey, and the like. It is desirable that an individual be able to gradually increase the rigorousness of the exercising program as the muscles are strengthened, and thus able to meet a greater and more demanding exercising challenge. Moreover, it is desirable that the devices used for exercising the hand, wrist and forearm be readily and simply adapted for use by either men, women or children according to individual physical exercising capabilities.

In none of the devices of the above-mentioned patents is provision made for varying the number of springs or for conveniently removing and installing springs possessing different torsional ratings in order to adapt to individual needs and preferences.

SUMMARY OF THE INVENTION

According to the present invention, there is contemplated the provision of a torsional-twist wrist exercising device incorporating manipulatable hand grips which can be readily adapted to internally accommodate a different quantity of torsion springs and/or springs having differing torsional spring ratings or constants. In this manner, the effort required for relative rotational movement between the hand grips of the device can be either decreased or increased as desired, predicated upon the intended user and rigorousness of the exercising program.

Accordingly, it is a primary object of this invention to provide a novel and unique hand-operated exercising device suitable for use in the exercising of the hand, wrist and forearm muscles.

A further object of the invention is the provision of an exercising device which can be adapted to increasing the exercising challenge to and demands upon the user by simple modification of the device.

A further object of the invention is the provision of a device of the mentioned type which is readily adapted for use by individuals having varying exercising skills, strengths and capabilities so as to impart a generally universal application and physical range thereto.

BRIEF DESCRIPTION OF THE DRAWINGS

These and other objects and purposes of the invention will become more readily apparent to persons familiar with devices of the general type disclosed herein, upon review of the description in conjunction with the accompanying drawings, in which.

DESCRIPTION OF THE PREFERRED EMBODIMENTS

Figure 1:
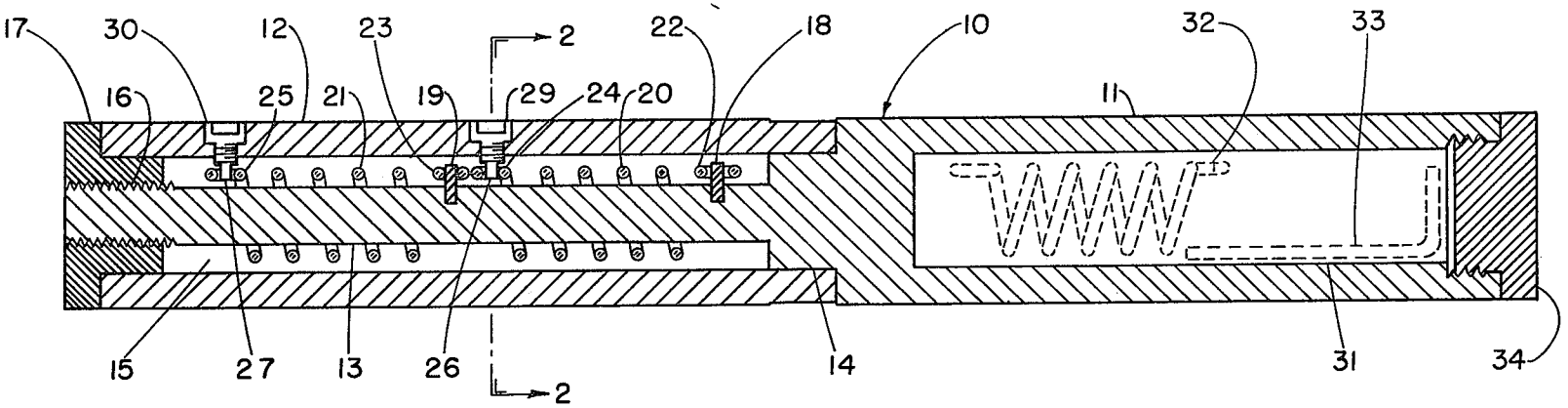
FIG. 1 is a longitudinal sectional view of an exercising device constructed in accordance with the invention.
Figure 2:
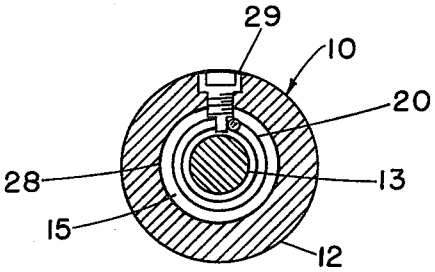
FIG. 2 is a sectional view taken along the line 2—2 in FIG. 1.

Referring now to FIG. 1 and FIG. 2 of the drawings, the inventive exercising device 10, which may be constructed of any suitable material such as metal, plastic, wood, or combinations thereof, capable of sustaining the stresses imposed upon it during use, comprises a pair of generally cylindrical hand grips 11 and 12 which extend in contiguous end-to-end relationship along a common central longitudinal axis. The exterior cylindrical surfaces of grips 11 and 12, or portions thereof, can be roughened for the purpose of providing better gripping engagement by a user. Thus, for example, such surfaces can be knurled, grooved, fluted, serrated, etc., to increase the friction between the user's palms and the grip surfaces. Alternatively, the grips may each be encompassed by a tightly fitted, non-slip or frictional material sleeve constituted of plastic, rubber, and the like, for accomplishing the same purpose. A central, coaxial longitudinally extending shaft 13 is affixed to or integrally formed with grip 11 so as to project from reduced diameter portion 14. Grip 12 is provided with a central longitudinally extending bore 15, which is formed therein for coaxially receiving the shaft 13. The diameter of bore is dimensioned so that it seats upon the reduced diameter portion 14 of grip 11. The free or distal end of shaft 13 is externally threaded at 16 to receive internally threaded cap member 17 having an outer reduced diameter surface which engages with the other end of bore 15 of the grip 12. Cap member 17 thus maintains the hand grips 11 and 12 in contiguous end-to-end relation during exercising use of the device. A pair of externally projecting spring retaining members or pins 18 and 19 are threadably mounted upon the shaft 13 or otherwise rigidly fastened thereto. Torsion springs 20 and 21 are loosely supported on and extend about shaft 13 and are each provided with loops 22 and 23, respectively, at one of their ends. The loops are readily engageable with the proximately located spring retaining members 18 and 19. The other ends of the springs 20 and 21 are provided with similar loops 24 and 25. These loops 24, 25 are engageable with spring retaining members 26 and 27 which project radially inwardly from wall 28 forming the interior cylindrical surface of bore 15. Spring retaining members 26 and 27 are, respectively, extensions of set screws 29 and 30 which are threadedly supported in threaded apertures provided in the grip 12 at suitable axially spaced locations in alignment with the loops 24 and 25 of the springs. Thus, for example, suitable adjustment of set screw 29 radially relative to the central longitudinal axis of the device will cause spring retaining member 26 to engage or disengage loop 22 of spring 20, and similarly will permit movement of set screw 30 with regard to spring retaining member 27. Grip 11 may be provided with a compartment 31 formed by a bore therein for storing one or more additional springs 32 and a wrench 33 which is employed for adjusting set screws 29 and 30. The open end of grip 11 is provided with end cap 34 having an external thread adapted to engage an internal thread in compartment or bore 31 so as to close off the latter and retain the springs and wrench stored therein.

Springs 20 and 21, and spare spring or springs 32, may have the same or differing torsional spring constants and may be readily dismounted from the shaft 13 and interchanged to vary the combined operative spring force and adapt the use of the device to men, women and children according to individual exercising programs and physical capabilities. In addition to being operable with but a single spring supported in place on shaft 13, it is readily understood that exercising device 10 can be modified to accommodate more than the two functional torsion springs shown merely by making provision for one or more additional sets of spring retaining members and modifying the length of the device and/or torsion springs.

In operation, the manually-engageable grip 11 has a partial clockwise rotation imparted to the grip at the same time as the hand grasping grip 12 has an anticlockwise rotation of equal magnitude imparted thereto. These simultaneous opposing rotational movements formulate torque load, resulting in compressive or tensile force, to the spring, which in turn renders continued rotational movement of the grips 11 and 12 relative to each other increasingly difficult, and demanding ever-increasing physical force by the user, thus strengthening his or her muscles.

Although a particular preferred embodiment of the invention has been disclosed in detail hereinabove for illustrative purposes, it will be recognized that variations or modifications of the disclosed device, including the rearrangement of components thereof, lie within the scope of the present invention.

What is claimed is:

1. A torsional twist wrist exercising device which comprises:

(a) a pair of hand grips having roughened exterior surfaces disposed in contiguous end-to-end relation on a common central longitudinal axis, said grips being operatively interconnected with each other so as to normally maintain their contiguous relation, but permitting rotative movements thereof relative to each other about their common axis;

(b) a central longitudinally extended shaft affixed at one end to one of the grips, the other end of said shaft being free;

(c) a central longitudinally extended bore of diameter greater than the diameter of the shaft formed within the other grip for coaxially receiving the shaft;

(d) a plurality of torsion springs operatively supported upon the shaft;

(e) a plurality of projecting members supported upon the shaft each of which is adapted to engage a loop formed at one end of each spring;

(f) a plurality of projecting members supported upon the wall defining the interior surface of the bore each of which is adapted for alternatively engaging and disengaging a loop formed at the other end of each loop;

(g) a cap member threadably engaged to the free end of the shaft for maintaining the grips in contiguous end-to-end relation during exercising use;

(h) a compartment formed within the grip to which the shaft is attached; and (i) a closure member for the compartment.

2. The device of claim 1 possessing two torsion springs operatively supported upon the shaft.

* * * * *